United States Patent [19]

Szczepanski

[11] Patent Number: 4,659,083

[45] Date of Patent: Apr. 21, 1987

[54] GOLF CLUB WITH CONVERGING DIRECTIONAL INDICIA

[76] Inventor: Harry Szczepanski, 755 Oakleigh, N.W., Grand Rapids, Mich. 49504

[21] Appl. No.: 787,991

[22] Filed: Oct. 16, 1985

[51] Int. Cl.[4] ..... A63B 53/00; A63B 69/36

[52] U.S. Cl. ..... 273/164; D21/219; 273/80 C

[58] Field of Search ..... 273/164, 168, 183 D, 273/163 R, 163 A, 162 B, 162 R, 167 R, 167 D, 186 A; D21/219

[56] References Cited

U.S. PATENT DOCUMENTS

D. 205,041 6/1966 Capps ..... 273/164 X 1,485,272 2/1924 Kinsman ..... 273/164

2,838,312 6/1958 Drake ..... 273/183 D 3,191,936 6/1965 Guier ..... 273/168 X

FOREIGN PATENT DOCUMENTS 313699 6/1929 United Kingdom ..... 273/164

*Primary Examiner*—George J. Marlo

*Attorney, Agent, or Firm*—Glenn B. Morse

[57] ABSTRACT

The head of a golf club is provided with directional indicia oriented to the path of movement of the face of the club. Groups of lines converging in the direction of striking form the indicia. Projections of the lines converge with an axis perpendicular to the face of the club at points in front of the face.

8 Claims, 6 Drawing Figures

GOLF CLUB WITH CONVERGING DIRECTIONAL INDICIA

BACKGROUND OF THE INVENTION

About half of the strokes of a round of golf take place on the greens, where two putts per green is considered good performance. There is an exasperating tendency, even for good players, to upset an otherwise good score by requiring three or more putts after some very respectable fairway shots. Much attention has been given to the design of the putter in an effort to reduce the poor putting performance experienced sooner or later by all players.

Part of the problem centers in the necessarily gentle and slow stroke involved in putting, leaving the muscles of the player plenty of opportunity for erratic behavior without the stablizing affect of club head inertia at high speed. Attempts have been made to make the player more aware of the path of movement of the club head by adding indicia to the top surface. These indicia have included parallel lines and arrows, all perpendicular to the club face. These have been only partially satisfactory. One putter that has been found available to golfers has a head provided with a V-shaped marking on the face, with the axis of the V perpendicular to the face. This marking is positioned with the apex of the V directly at the club face, and is intended to indicate the "sweet spot", which is the common term indicating the center of mass of the putter head.

SUMMARY OF THE INVENTION

Applicant has found that groups of lines converging from opposite sides of an axis perpendicular to the face of the club have the effect of making the player more acutely aware of the direction of movement of the club than any other known form of indicia. Projections of the lines should converge toward points on the axis located several golf ball diameters in front of the face of the club. The axis of the converging lines should be directly above the center of mass of the club head, with the club in normal putting position.

DESCRIPTION OF THE PREFERRED EMBODIMENT

Figure 1:
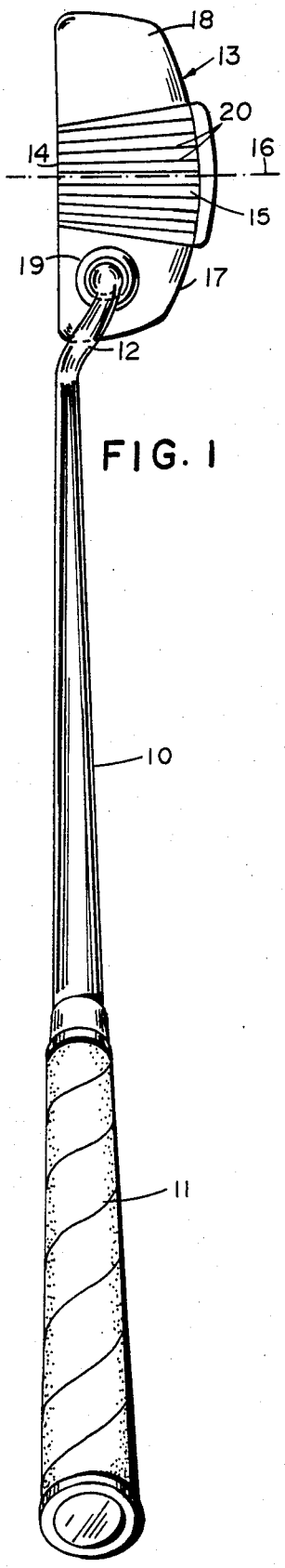
FIG. 1 is a perspective view looking down the shaft of a putter, as the player would see it in normal putting position.
Figure 3:
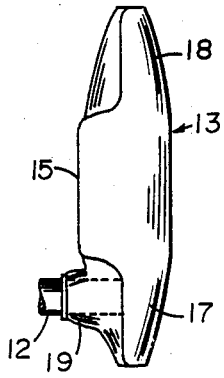
FIG. 3 is a rear elevation of the putter head shown in FIG. 1.

Referring to FIG. 1, the illustrated putter has a shaft 10 with a wrapped covering material 11 providing a handle. It is conventional to provide the shaft 10 with an offset as indicated at 12 to place the axis of the handle shaft in proper relationship with the center of mass of the club head 13. The head has a striking face 14 and a central raised area providing the surface 15. The axis of this area indicated at 16 passes directly above the center of mass of the club head, in the position of the putter shown in FIG. 1. The configuration of the side extensions 17 and 18 is a matter of design, reflecting the necessity to present a striking face 14 of a given area, and a weight of the club head within the desired limits. The boss 19 is conventional, and provides a socket for receiving the lower extremity of the shaft 10.

A pattern of converging lines indicated generally at 20 is applied to the central top surface 15 to function as directional indicia. The axis of these lines coincides with the axis 16. Projections of these lines in front of the striking face all converge with the axis at a point several ball diameters in front of the face. The apparently accepted diameter of a standard golf ball is approximately one and five-eighths inches.

Figure 2:
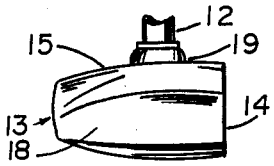
FIG. 2 is a side elevation of the head of the putter appearing in FIG. 1.

Referring to FIG. 2, the preferred configuration of the central surface 15 presents a flat plane in the portion nearest to the face 14, changing to a cylindrical curvature toward the rear. It has been found that this arrangement provides the best light-reflection characteristics, and gives a greater possibility of producing a bright spot at least somewhere along the pattern of converging lines 20.

Figure 5:
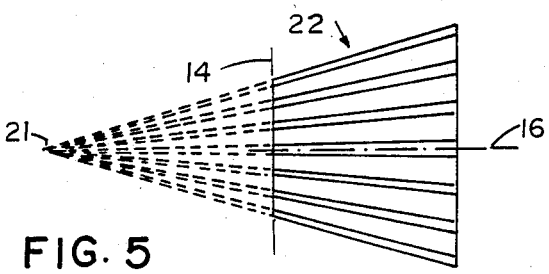
FIG. 5 is a view similar to FIG. 4, showing a point of convergence approximately one and a half ball diameters in front of the face of the club.
Figure 4:
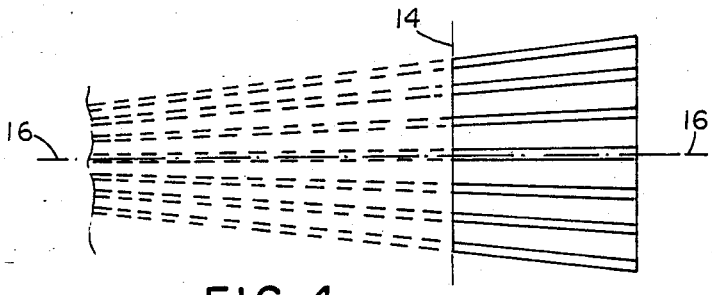
FIG. 4 is a schematic view showing a pattern of lines converging toward a point three or four ball diameters in front of the face of the club.
Figure 6:
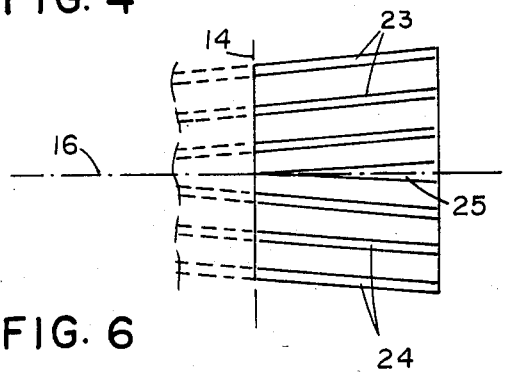
FIG. 6 shows a modified arrangement of converging lines in which parallel lines on each side of the axis converge toward the axis at a common angle.

The geometric relationships of the pattern of converging lines is best illustrated in FIGS. 4, 5, and 6. In FIG. 4, the lines converge toward a point which is approximately three to four ball diameters in front on the striking face 14. In these views the face is indicated as a plane. The lines themselves, which are indicated at 22, are wedge-shaped, with the sides of the lines converging at the same point. Each of the lines has a common angle with respect to the line next to it. These angular increments can be of the order of two degrees. In FIG. 5, the arrangement is similar to that of FIG. 4, except that the point of convergence is approximately one and a half ball diameters in front of the face 14. Here the angular increment is preferably on the order of five degrees. In FIG. 6, a slightly different convergence arrangement is utilized. The groups of lines on each side of the axis, indicated respectively at 23 and 24, have a common angle of convergence to the axis 16. The lines of each group are parallel to each other, and the sides of the lines themselves are parallel in this modification. The central line 25, which is directly on the axis 16, is V-shaped.

Whichever pattern is preferable may be applied to the face 15 in several different ways. One possibility is to cast the line configuration directly into the metal of the club head 13. Another option is to provide a decal that can be adhesively secured to the surface 15. Various color arrangements can be utilized, and it has been found that one very effective arrangement is a bright orange center line, with white lines on each side separated by yellow spaces between the lines. This color arrangement can be varied according to personal preference.

The significance of these patterns of converging lines centers in the discovery that a player looking at them, even for a brief moment, receives an instant sense of direction which is much more positive than in the case of one or more lines all perpendicular to the face of the club. This only seems to be true, however, when the point of convergence of the lines is considerably in front of the club face. The reason for this, in terms of psychological involvement, is by no means clear at this time. The result of this visual impact, and the resulting directional sense, is two-fold. First, it gives the player a very accurate sense of the orientation of the club face. Second, as the club head moves during the putting stroke, the converging pattern seems to be impressed on the player's eye in such a way that he is more acutely aware of the path of the putting stroke. He is thus more easily able to correct the most common cause of erratic putting. Players that have used various experimental versions of this putter have also commented that the visual impact of the indicia pattern gives them a confident sense of club alignment in a much shorter time as they address the ball, thus removing a tendency for the player to develop a muscular tension as the alignment effort is continued. A freer and more reliable putting stroke has been the observed result in almost all cases. Those players of an analytical turn of mind have also noted that they can become aware of the directional pattern with peripheral vision, leaving their principal vision directed more along the estimated path of movement of the ball. All of this obviously tends to reduce directional errors, leaving the player more free to concentrate on the intensity of his stroke.

I claim:

1. A golf club having a handle, shaft and a head with a striking face and a top surface extending from said face, wherein the improvement comprises:

directional indicia incorporated in said top surface, said indicia including groups of line elements converging toward an axis perpendicular to said face, and disposed so that projections of said lines intersect said axis in front of said face.

2. A golf club as defined in claim 1, wherein said lines converge at substantially constant angular increments.

3. A golf club as defined in claim 1, wherein said lines on each side of said axis are at a common angle with respect to said axis.

4. A golf club as defined in claim 1, wherein said line elements taper to reduced width in the direction of convergence.

5. A golf club as defined in claim 1, wherein said projections intersect said axis at a distance from said face of at least two diameters of a standard golf ball.

6. A golf club as defined in claim 1, wherein at least a portion of said lines lie on a curved surface.

7. A golf club as defined in claim 6, wherein said surface has single curvature.

8. A golf club as defined in claim 1, wherein said axis is directly above the center of mass of said head, in the normal striking position of said club.

* * * * *